US007328735B2

(12) United States Patent
O et al.

(10) Patent No.: US 7,328,735 B2
(45) Date of Patent: Feb. 12, 2008

(54) APPARATUS AND METHOD FOR FORMING PHOSPHOR LAYERS ON A DISPLAY PANEL

(75) Inventors: Hyeon Seok O, Suwon (KR); Min Goo Choi, Gunpo (KR)

(73) Assignee: LG Electronics Inc., Seoul (KR)

( * ) Notice: Subject to any disclaimer, the term of this patent is extended or adjusted under 35 U.S.C. 154(b) by 16 days.

(21) Appl. No.: 10/932,008

(22) Filed: Sep. 2, 2004

(65) Prior Publication Data

US 2005/0076836 A1 Apr. 14, 2005

(30) Foreign Application Priority Data

Sep. 30, 2003 (KR) ..... 10-2003-0067761

(51) Int. Cl.
*B05C 11/10* (2006.01)
*B05B 5/025* (2006.01)

(52) U.S. Cl. ..... 156/500; 156/624; 156/628; 156/629

(58) Field of Classification Search ..... 118/624, 118/628, 629, 500, 712, 713; 427/9
See application file for complete search history.

(56) References Cited

U.S. PATENT DOCUMENTS 5,843,232 A * 12/1998 Savkar et al. ..... 118/712
6,120,834 A * 9/2000 Terauchi ..... 430/5
6,214,501 B1 * 4/2001 Park ..... 430/23
6,310,344 B1 * 10/2001 Shin et al. ..... 250/326
6,595,819 B1 * 7/2003 Kitahara et al. ..... 445/24
2002/0009536 A1 * 1/2002 Iguchi et al. ..... 427/10

OTHER PUBLICATIONS

English Language Abstract of Korean Publication No. 1998-0024713, publication date is Jul. 6, 1998.
English Language Abstract of Korean Publication No. 1999-0082585, publication date is Nov. 25, 1999.

* cited by examiner

*Primary Examiner*—George Koch
(74) *Attorney, Agent, or Firm*—Birch, Stewart, Kolasch & Birch, LLP

(57) ABSTRACT

An apparatus for forming phosphor layers on a display panel includes a base plate on which a display panel is placed. The base plate is inclined at an adjustable angle. The display panel, having a panel plate and barrier ribs formed on the panel plate is placed on the base plate. A spray unit includes a nozzle assembly for spraying a slurry containing phosphors into spaces between the barrier ribs. A charged unit for exerting electrostatic force on the phosphors is positioned adjacent to the display panel. The apparatus enables rapid formation of uniform phosphor layers on a display panel with the phosphor particles located adjacent to the surfaces of the phosphor layers.

20 Claims, 4 Drawing Sheets

APPARATUS AND METHOD FOR FORMING PHOSPHOR LAYERS ON A DISPLAY PANEL

The present application claims, under 35 U.S.C. § 119, the priority benefit of Korean Patent Application No. P03-067761 filed Sep. 30, 2003 in Republic of Korea, the entire contents of which are herein fully incorporated by reference.

BACKGROUND OF THE INVENTION

1. Field of the Invention

The present invention relates to a display panel, and more particularly to an apparatus and method for forming phosphor layers between barrier ribs on a display panel.

2. Description of the Related Art

As generally known in the art, a flat panel display (FPD) refers to a liquid crystal display (LCD) or a plasma display panel (PDP). Especially, a plasma display panel is a flat display panel including a pair of substrates (usually glasses) as base members, which are opposed to and apart from each other so as to form an electric discharge space between them. The plasma display panel has ultraviolet ray-excited phosphor layers formed in the discharge space, so that the phosphor layers can be excited by electric discharge, thereby displaying colors. Usually, a display panel has phosphor layer of R (red), G (green), and B (blue).

In order to form phosphor layers on a display panel as described above, phosphor powder having particle sizes of several μm to several tens of μm is used. Such phosphors are applied on the display panel by a slurry method, a screen printing method, an inkjet printing method, etc.

Specifically, in the slurry method, base coating solution is applied and dried on an upper surface of a lower panel on which barrier ribs have been formed, and slurry containing phosphors, surfactants, dispersants, etc., is then applied on a central portion of the lower panel. Then, the lower panel is rotated so that the slurry can be uniformly distributed. Thereafter, a shadow mask is place above the lower panel, and ultraviolet rays are then shed on the lower panel through the shadow mask. Thereafter, the lower panel is subjected to a development process, in which the lower panel is washed by warm water, so that phosphor layers patterns of specific colors are formed on the panel.

Next, in the screen printing method, a paste containing phosphors is squeezed and transcribed onto a screen such as a silk screen or a stainless mesh by a squeezer, so that phosphor layer patterns of specific colors are formed on the panel.

Of course, in order to facilitate separation of the screen from the panel, the panel and the screen should be apart from each other with a sufficient gap between them. Further, a stable squeeze angle is set for rotation of the paste, and a relatively low squeeze pressure should be maintained in order to prevent the screen from being damaged. Further, a squeeze velocity should be set in consideration of fluidity of the paste.

Meanwhile, in the inkjet printing method, ink containing phosphors is sprayed directly into gaps between barrier ribs on the panel, so that phosphor layer patterns of specific colors are formed on the panel.

However, the related art methods of forming phosphor layers, as described above, have the following problems.

The related art slurry method for forming phosphor layers on a panel has many steps, which is expansive and requires a large space for manufacturing facilities. Also, a large quantity of pure water is required by the method. Further, in the related art slurry method, injection, development, and dehydration of phosphors require consumption of a large quantity of electric energy, which further increases the manufacturing cost.

Meanwhile, in the related art screen printing method for forming phosphor layers on a panel, it is difficult for some workers to form phosphor layer patterns with a specific size and shape. Further, the screen may be blocked, causing it to be difficult to form phosphor layers with a high resolution. Moreover, mechanical processing is necessary in order to wash used masks, thereby causing the manufacturing process to be more complicated.

Also, in the related art inkjet printing method for forming phosphor layers on a panel, when a phosphor layer pattern is not linear, scanning of the phosphor layer pattern is necessary, requiring a long time, which deteriorates productivity. Meanwhile, when a plurality of nozzle heads and CCD (charge coupled device) cameras are employed in order to improve the productivity, a large space and a complicated construction for installation of them are necessary.

SUMMARY OF THE INVENTION

Accordingly, the present invention has been made to solve one or more of the above-mentioned problems occurring in the related art, and an object of the present invention is to provide an apparatus and method, which can form uniform phosphor layers between barrier ribs on a display panel.

It is another object of the present invention to provide an apparatus and method of forming phosphor layers between barrier ribs on a display panel, in which each of the phosphor layers contains phosphors located adjacent to a surface thereof.

It is another object of the present invention to provide an apparatus and method, which can more uniformly supply slurry containing phosphors to gaps between barrier ribs on a display panel.

In order to accomplish these objects, there is provided an apparatus for forming phosphor layers on a display panel, the apparatus comprising: a base plate on which a display panel is placed, the base plate being located in such a manner that the base plate can be inclined at an adjustable angle, the display panel having a panel plate and barrier ribs formed on the panel plate; a supply tank for storing slurry containing phosphors to be applied on the display panel; a spray unit including a nozzle assembly for spraying the slurry in the supply tank into spaces between the barrier ribs of the display panel; and a charged unit for exerting electrostatic force on the phosphors contained in the slurry sprayed in the spaces between the barrier ribs.

The base plate is inclined at a predetermined angle when the slurry is supplied to the spaces between the barrier ribs and is horizontally placed when the slurry is dried to form the phosphor layers.

The nozzle assembly has a nozzle entrance port, a nozzle exit port, and a plurality of fluid channels for interconnecting the nozzle entrance port and the nozzle exit port. The fluid channels include channels of different degrees, which are connected in such a manner that each channel is divided into two channels of a higher or next degree.

Each channel has a sectional area which is twice as large as a sectional area of each of the two channels of the higher degree.

The spray unit further includes: a spray driving assembly movably disposed in the supply tank so as to enable the slurry contained in the supply tank to be transferred to the nozzle entrance port; and a spray control unit for controlling operation of the spray driving assembly so as to control a speed and pressure at which the slurry is sprayed out of the nozzle assembly.

The apparatus may further comprise a monitoring section for providing information to be used in controlling spray of the slurry onto the display panel, wherein the monitoring section includes: an image acquisition unit for detecting flow of the slurry on the display panel; and a thickness sensor for detecting a thickness of the slurry applied on the display panel.

The monitoring section further includes an information processing unit, which obtains error values by comparing a location and thickness of the phosphor layers detected by the image acquisition unit and the thickness sensor with preset values. The processing unit generates correction values based on the error values, and transmits the correction values to the spray control unit.

The charged unit may include: a driving motor; a charged belt driven by the driving motor, at least a surface of the charged belt being made from dielectric material; and a power supply unit for supplying electricity to the dielectric material of the charged belt so that the charged belt is selectively charged with electric charges. The charged unit is separated from a surface of the display panel by a predetermined gap and can be adjusted to be inclined at various angles.

The charged unit may also include: a charged unit substrate having a predetermined area; a plurality of electrodes arranged with a regular interval on a surface of the charged unit substrate opposed to the base plate; and a power supply unit for selectively supplying electricity to the electrodes, wherein the charged unit is apart from a surface of the display panel by a predetermined gap and can be adjusted to be inclined at various angles.

In accordance with another aspect of the present invention, there is provided a method for forming phosphor layers on a display panel, the method comprising the steps of: inclining a display panel at a predetermined angle, the display panel having a panel plate and barrier ribs formed on the panel plate; supplying slurry onto the display panel inclined at the predetermined angle; and exerting electrostatic force on the slurry located on the display panel by a charged unit disposed above the display panel.

The method may further comprise the steps of: horizontally locating the display panel after the slurry is completely supplied onto the display panel; and drying phosphor layers applied on the display panel while the charged unit exerts the electrostatic force on the phosphor layers so as to attract phosphors in the phosphor layers toward surfaces of the phosphor layers.

Electric charges charged on the charged unit may be moved in a direction in which the slurry flows, so as to facilitate movement of the phosphors in the slurry.

Otherwise, the charged unit includes a plurality of electrodes, which are sequentially charged in a direction in which the slurry flows, so as to facilitate movement of the phosphors in the slurry.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
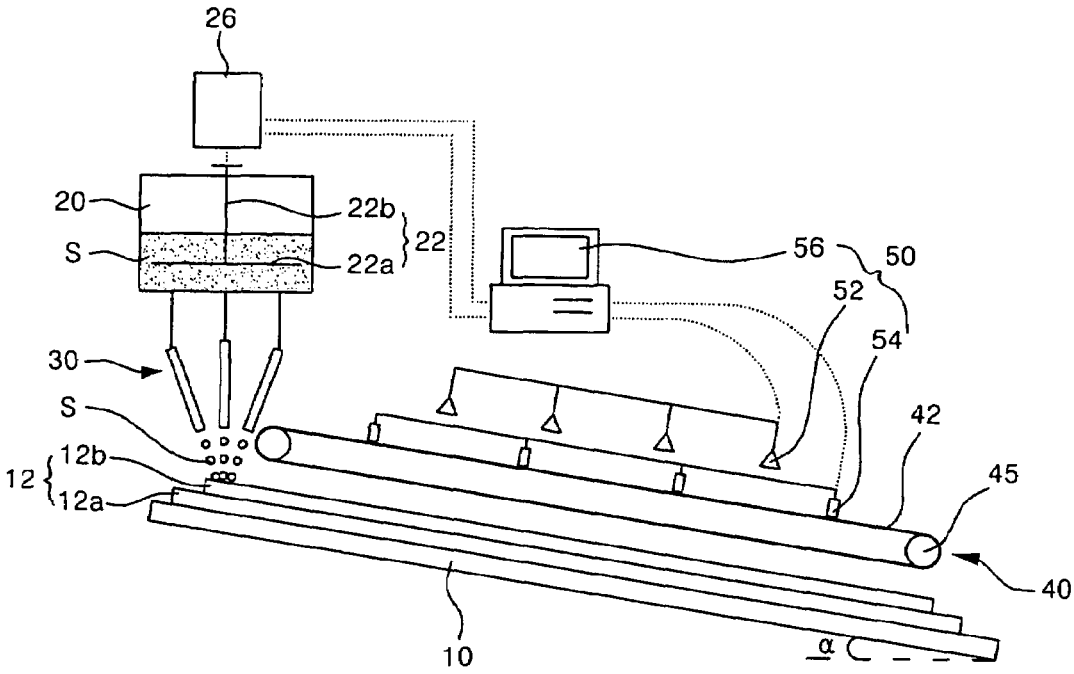
FIG. 1 illustrates a construction of an apparatus for forming phosphor layers between barrier ribs on a display panel according to a first embodiment of the present invention.

Hereinafter, apparatuses and methods for forming phosphor layers between barrier ribs on a display panel according to preferred embodiments of the present invention will be described with reference to the accompanying drawings.

Referring to the drawings, a base plate 10 is a member on which a display panel 12 is placed. The base plate 10 has a flat upper surface having an area which allows the display panel 12 to be placed on the flat upper surface. The base plate 10 is inclined at a predetermined angle and can be adjusted to be inclined at various angles, with respect to a horizontal plane.

The display panel 12, placed on the base plate 10, includes a panel plate 12*a* and barrier ribs 12*b*. The panel plate 12*a* is usually made from glass, and the barrier ribs 12*b* are formed on an upper surface of the panel plate 12*a* and apart from each other with predetermined intervals. The display panel 12 is a portion of a flat display device.

Figure 4:
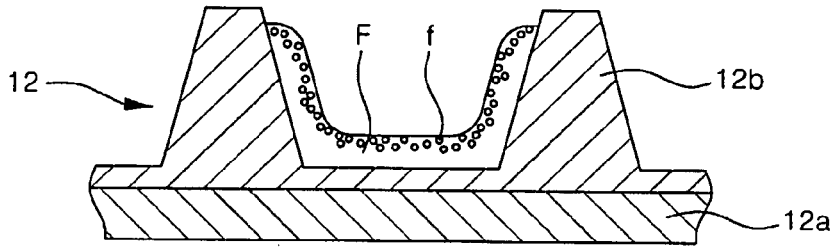
FIG. 4 is a cross-sectional view of a portion of a display panel on which a phosphor layer has been formed according to a method of the present invention.

A supply tank 20 is a device for storing slurry S which is material for phosphor layers F (see FIG. 4) formed between the barrier ribs 12*b* of the display panel 12. A spray driving assembly 22 for discharging the slurry S out of the supply tank 20 is disposed in the supply tank 20. The spray driving assembly 22 controls discharge of the slurry S from the supply tank 20.

The spray driving assembly 22 includes, for example, a push plate 22*a* and a push rod 22*b*. The push plate 22*a* pushes the slurry S with a predetermined pressure, and the push rod 22*b* drives the push plate 22*a* to push the slurry S. Although not shown, it goes without saying that the spray driving assembly 22 includes another element which provides a driving force for driving the push rod 22*b*.

Further, the discharge of the slurry S from the supply tank 20 is controlled by a spray control unit 26. The spray control unit 26 controls the operation of the push rod 22*b*, thereby controlling the velocity and pressure at which the slurry S is discharged.

A nozzle assembly 30, e.g., a spraying unit, is connected to the supply tank 20. The nozzle assembly 30 sprays the slurry S into spaces between the barrier ribs 12*b* of the display panel 12. First to fourth fluid channels 31, 32, 33, and 34 are formed through a nozzle assembly body 30*b* of the nozzle assembly 30 and are connected in turn with each other so as to enable a nozzle entrance port 35 and a nozzle exit port 36 to communicate with each other. The first to fourth fluid channels 31, 32, 33, and 34 are formed in such a manner that an upstream fluid channel is divided into two branches forming downstream fluid channels. Each of the first to fourth fluid channels 31, 32, 33, and 34 has a semicircular or arcuate shape.

To be more specific about the first to fourth fluid channels 31, 32, 33, and 34, the first fluid channel 31 is divided into two second fluid channels 32 at a lower end of the first fluid channel 31, and each of the second fluid channels 32 is divided into two third fluid channels 33 at a lower end of the second fluid channel 32. Therefore, in the nozzle assembly 30 according to the present embodiment, eight fourth fluid channels 34 are formed for one first fluid channel 31, and the slurry S introduced through one first fluid channel 31 is discharged through eight fourth fluid channels 34. However, fluid channels may be formed in the nozzle assembly to have branches of a higher degree beyond the fourth, so that a larger number of fluid channel branches may be formed in the nozzle assembly 30.

Here, each of the first to fourth fluid channels 31, 32, 33, and 34 has a sectional area which is a half of that of a channel having a degree just one step higher than the degree of that channel. That is, a cross-sectional area of flow through each of the first to fourth fluid channels 31, 32, 33, and 34 is reduced to one-half, whenever the degree of the fluid channel changes or increases by one step.

Such arcuate shapes of the fluid channels and one-half reduction of the cross-sectional area of the flow through the fluid channels as described above minimize resistance to flow of the slurry S through the fluid channels and enable the slurry S to be discharged at a uniform pressure.

In the nozzle assembly 30, entrance ports of the first fluid channels 31 serve as the nozzle entrance ports 35 of the nozzle assembly 30, and exit ports of the fourth fluid channels 34 serve as the nozzle exit ports 36 of the nozzle assembly 30. The nozzle entrance port 35 is connected to the supply tank 20, and the nozzle exit ports 36 are separated from each other with intervals corresponding to the spaces between the barrier ribs 12*b* of the display panel 12.

In manufacturing the nozzle assembly 30, a selectively removable material is first applied on a first substrate. Then, the material is selectively eliminated through an exposure step, etc., so as to form grooves, shaped like the first to fourth fluid channels 31, 32, 33, and 34, on the first substrate. Thereafter, a second substrate is attached to the first substrate so that the grooves are covered. Then, the manufacture of the nozzle assembly 30 is completed. Here, the first substrate, the second substrate, and a remaining portion of the material together form the nozzle assembly body 30*b*.

Figure 2A:
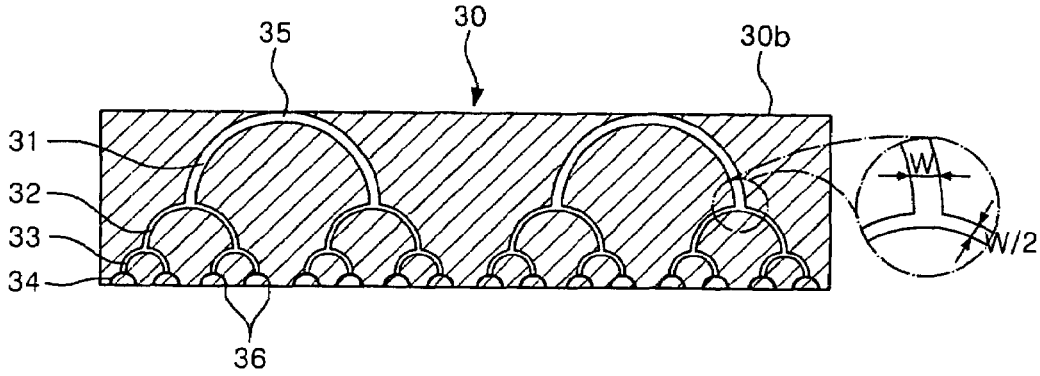
FIG. 2*a* is a cross-sectional view of a nozzle assembly employed in the apparatus according to the first embodiment of the present invention.
Figure 2B:
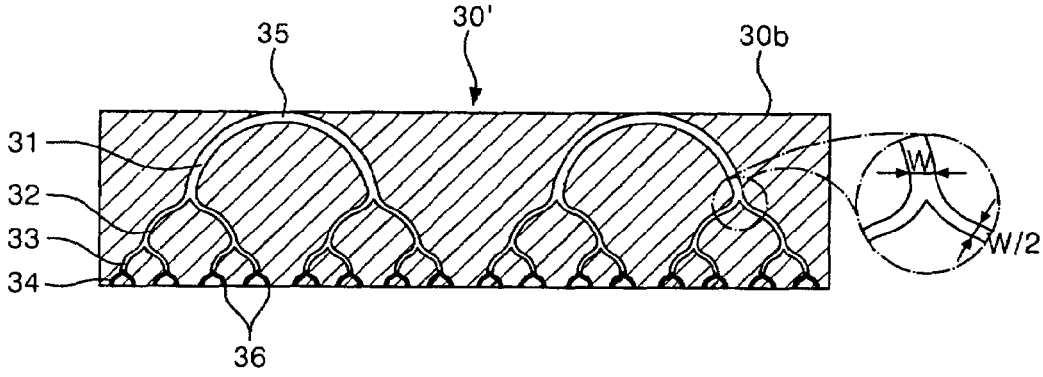
FIG. 2*b* is a cross-sectional view of another nozzle assembly having a modified construction from that shown in FIG. 2*a;*

FIG. 2*b* shows a nozzle assembly according to another embodiment. In a nozzle assembly 30' shown in FIG. 2*b*, each of the first to fourth fluid channels 31, 32, 33, and 34 does not have an exactly semicircular or arcuate shape. Specifically, there is no such angular connection between the first to fourth fluid channels 31, 32, 33, and 34 as shown in FIG. 1*b*. Instead, the nozzle assembly 30' has portions interconnecting the first to fourth fluid channels 31, 32, 33, and 34, each of which extends along a smooth curve without an angular portion, thereby further reducing resistance to flow through the first to fourth fluid channels 31, 32, 33, and 34 in the nozzle assembly 30'.

Figure 2C:
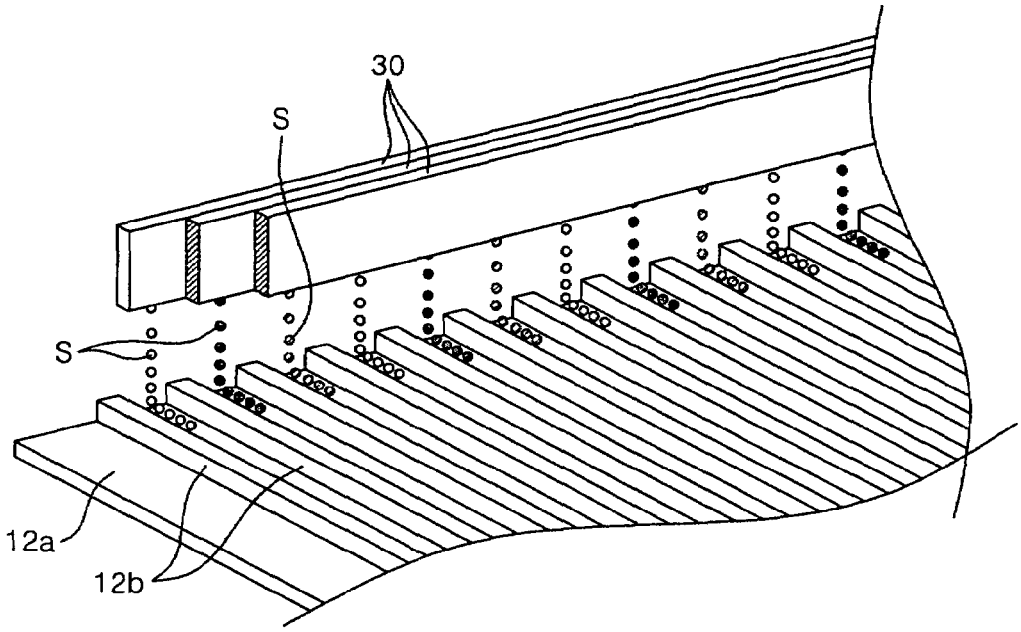
FIG. 2*c* is a a schematic perspective view illustrating an alignment of three nozzles, for applying red, green and blue phosphors.

It is preferred that the nozzle assembly 30 or 30' is separately arranged for spray of each of red, green, and blue phosphors f, so as to minimize interference between the phosphors of different colors. That is, it is preferred that three nozzle assemblies 30 or 30' are arranged for spraying the three colors, respectively, as illustrated in FIG. 2*c*. The spray of the phosphors f by each of the nozzle assemblies 30 or 30' is controlled by the spray control unit 26. Of course, it is also preferred that the same number of the supply tanks 20 as that of phosphors f are arranged, so as to supply phosphors of different colors to the nozzle assemblies 30 or 30', respectively.

Next, a charged unit 40 is disposed above the base plate 10. The charged unit 40 enables phosphor layers F to be formed in the spaces between the barrier ribs 12*b* of the display panel 12 and phosphors f to be located at relatively upper portions of the phosphor layers F.

The charged unit 40 includes a charged belt 42 driven by a driving motor 41. The charged belt 42 has a surface opposed to the display panel 12, which has an area corresponding to the area of the display panel 12. The charged belt 42 may be made from dielectric material which is electrically charged when electricity is supplied to the dielectric material. Otherwise, the charged belt 42 may be made from non-dielectric material and coated with dielectric material which is electrically charged when electricity is supplied to the dielectric material.

Figure 3:
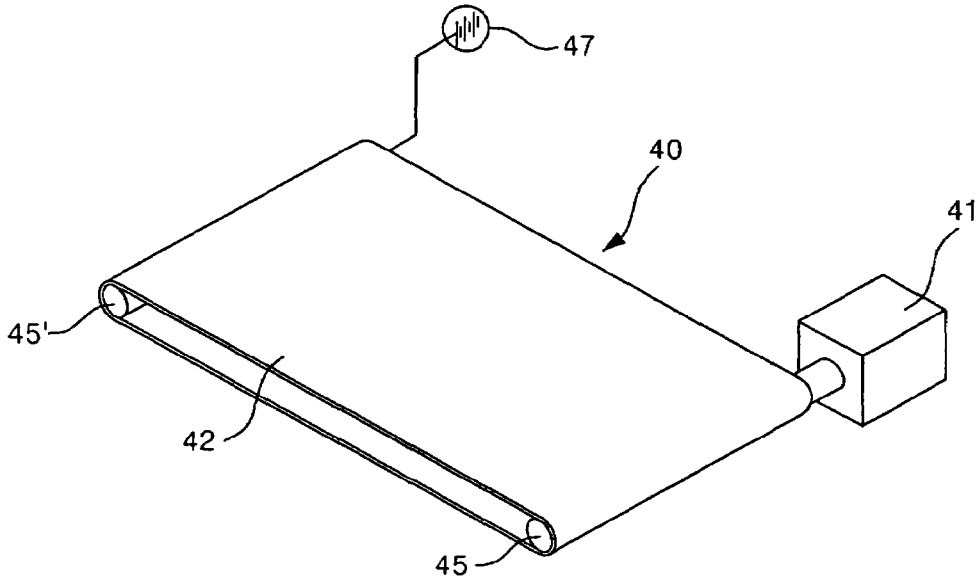
FIG. 3 is a schematic perspective view of a charged unit employed in the apparatus according to the first embodiment of the present invention.

The charged belt 42 has opposite ends wound around rotation shafts 45 and 45', at least one of which is driven or rotated by the driving motor 41. It goes without saying that the charged belt 42 is not necessarily driven by the rotation shaft 45 directly connected to the driving motor 41 as shown in FIG. 3. Instead, the driving force of the driving motor 41 may be transferred to the charged belt 42 through various media including other rotation shafts, gears or pulleys.

The charged belt 42 is connected to a power supply unit 47. The power supply unit 47 supplies electricity for electrically charging the charged belt 42. When the power supply unit 47 supplies electricity to the charged belt 42, the charged belt 42 is charged with positive or negative electric charges.

The charged unit 40 is inclined at a predetermined angle and can be adjusted to be inclined at various angles, with respect to a horizontal plane, in the same manner as that in the base plate 10. That is, the inclination $\alpha$ of the charged unit 40 with respect to a horizontal plane can be adjusted to have various values.

Next, the apparatus for forming phosphor layers on a display panel according to the present embodiment includes a monitoring section 50. The monitoring section 50 detects the thickness and length of each phosphor layer F applied on the display panel 12, and provides a control signal reflecting the detected information to the spray control unit 26. The spray control unit 26 controls the spray of the slurry S on the basis of the information provided by the monitoring section 50.

The monitoring section 50 includes image acquisition units 52. The image acquisition units 52 are located above the display panel 12 and take photographs of the display panel 12. Image data acquired by the image acquisition units 52 are used as a basis for determining a degree and an amount by which phosphor layers F are formed on the display panel 12.

The monitoring section 50 also includes thickness sensors 54. Each of the thickness sensors 54 is disposed a predetermined distance above the upper surface of the display panel 12 and detects the thickness of each phosphor layer F applied between the barrier ribs 12*b* of the display panel 12. Each of the thickness sensors 54 shoots a signal toward the upper surface of the display panel 12, and measures the time period until the signal returns after being reflected by the upper surface of the display panel 12, so as to measure the thickness of the phosphor layer F applied on the upper surface of the display panel 12.

An information processing unit 56 generates a control signal on the basis of the information provided by the image acquisition units 52 and the thickness sensors 54 and transfers the control signal to the spray control unit 26. Specifically, a location and thickness of each phosphor layer F is set and stored in advance in the information processing unit 56, and the information processing unit 56 obtains error values by comparing the location and thickness of each phosphor layer detected by the image acquisition units 52 and the thickness sensors 54 with the preset values, generates correction values on the basis of the error values, and transmits the correction values to the spray control unit 26. Then, the spray control unit 26 operates the spray driving assembly 22 according to the received correction values, so as to adjust spray pressure and speed of the slurry S.

Figure 5:
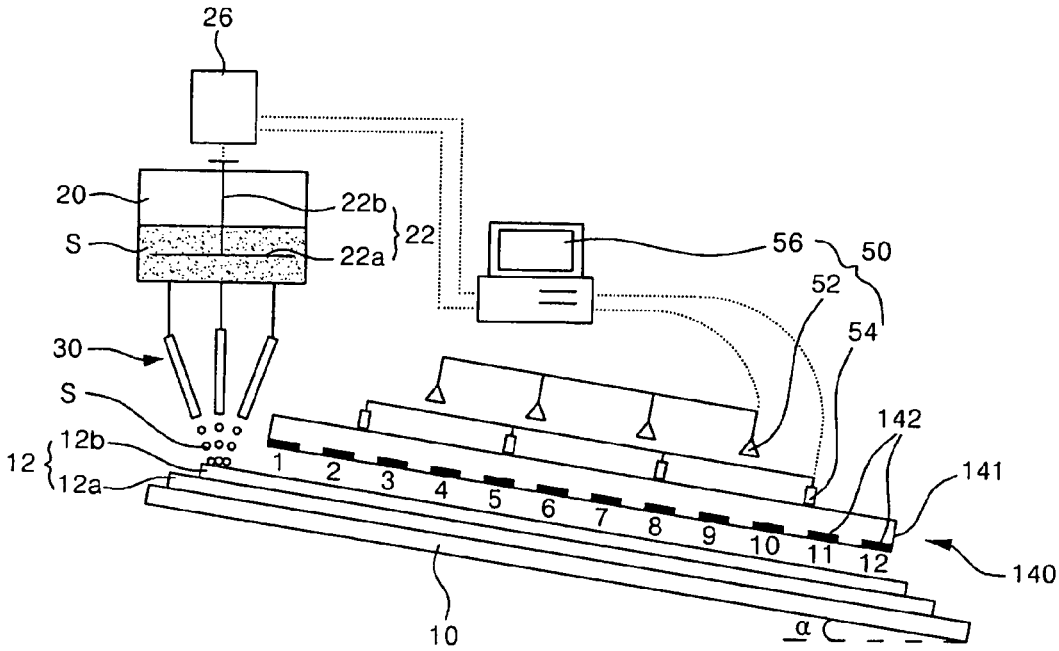
FIG. 5 illustrates a construction of an apparatus for forming phosphor layers between barrier ribs on a display panel according to a second embodiment of the present invention.

FIG. 5 shows a second embodiment of the present invention. In the following description of the second embodiment of the present invention, the same elements as those in the previous embodiment will be provided with the same reference numerals and detailed description of them will be omitted.

A charged unit 140 in the present embodiment, for uniform forming phosphor layers between barrier ribs on a display panel and enabling phosphors contained in each phosphor layer to be located adjacent to a surface of the phosphor layer, has a construction different from the construction of the charged unit 40 in the previous embodiment.

That is, the charged unit 140 disposed adjacently above an upper surface of the display panel 12 has a charged unit substrate 141 on which a plurality of electrodes 142 are formed. The charged unit substrate 141 has a surface opposed to the display panel 12, which has a shape and an area corresponding to the entire opposed surface of the display panel 12. The electrodes 142 are arranged with a regular interval on the charged unit substrate 141. The electrodes 142 are electrically charged by electricity supplied from a power supply (not shown).

In the same manner as that for the base plate 10, the charged unit 140 can be inclined at an adjustable angle with respect to a horizontal plane. That is, the inclination $\alpha$ of the charged unit 140 with respect to a horizontal plane can be adjusted to have various values.

The electrodes 142 fixed to the charged unit substrate 141 of the charged unit 140 are charged with electric charges, so as to facilitate movement of the slurry S and enable phosphors contained in the phosphor layers F to be located adjacent to surfaces of the phosphor layers F. On the charged unit substrate 141, the electrodes 142 may be either arranged to extend in directions perpendicular to the directions in which the barrier ribs 12*b* extend, or formed at locations corresponding to the phosphor layers F between the barrier ribs 12*b*.

The electrodes 142 may be either sequentially charged so that they sequentially have a specific polarity, or may be simultaneously operated to have a specific polarity. For example, first, electrodes of Nos. 1, 4, 7, and 10 are charged by applying voltage to them, and the other electrodes are kept uncharged. Next, electrodes of Nos. 2, 5, 8, and 11 are charged by applying voltage to them, and the other electrodes are kept uncharged. Thereafter, electrodes of Nos. 3, 6, 9, and 12 are charged by applying voltage to them, and the other electrodes are kept uncharged. In this way, the electrodes 142 can be sequentially charged with electricity.

Otherwise, the electrodes 142 are simultaneously charged with electricity by simultaneously applying voltage to all of the electrodes 142, so that the phosphors in all of the phosphor layers of the display panel 12 may be influenced by the electric charges.

Hereinafter, methods for forming phosphor layers by means of the phosphor layer forming apparatuses having the abovementioned construction, according to the present invention, will be described.

First, description will be given hereinafter on the basis of the embodiment shown in FIG. 1. A predetermined amount of slurry S, in which solution vehicle (including solvent and binder) and phosphor particles are mixed, is supplied to the supply tank 20. The slurry S, stored in the supply tank 20, flows by gravity through the first to fourth fluid channels 31, 32, 33, and 34 of the nozzle assemblies 30 or 30' while discharging all air out of the first to fourth fluid channels 31, 32, 33, and 34.

The display panel 12 is disposed on the base plate 10. The display panel 12 is located at a position which enables the nozzle assembly 30 or 30' to be aligned with a portion of the display panel 12 from which the phosphor layers F begin to be formed.

Next, the base plate 10 is inclined at a predetermined angle $\alpha$. Here, one end of the base plate 10 above which the nozzle assembly 30 or 30' is located should be located higher than the other end of the base plate 10. As a result, the display panel 12 placed on the base plate 10 is also inclined at the predetermined angle, so that the slurry S injected into the spaces between the barrier ribs 12*b* can flow downward by gravity. The inclination of the display panel 12 should be adjusted according to a viscosity of the slurry S.

Thereafter, the spray control unit 26 generates a predetermined operation frequency so as to operate the spray driving assembly 22, so that the nozzle assembly 30 or 30' sprays the slurry S containing R, G, and B phosphors f. In this case, the spray control unit 26 controls spray timing by the predetermined operation frequency, so that slurry S containing R phosphors f, slurry S containing G phosphors f, and slurry S containing B phosphors f can be separately and sequentially sprayed. By the control in this way, interference or agglomeration between phosphors f injected to adjacent spaces between the barrier ribs 12*b* can be minimized.

As the spray driving assembly 22 is operated under the control of the spray control unit 26, the slurry S in the supply tank 20 flows through the nozzle entrance port 35 and the first to fourth fluid channels 31 to 34. After being discharged from the nozzle assembly 30 or 30', the slurry S flows between the barrier ribs 12*b* of the display panel 12 by gravity and capillary action. In such flow of the slurry as described above, since the phosphors f have a specific gravity larger than that of the vehicle, the vehicle flows relatively rapidly through the spaces between the barrier ribs 12*b* of the display panel 12, but the phosphors f may settle on the upper surface of the display panel 12, thereby disturbing the flow of the slurry S.

In order to solve this problem, the charged belt 42 of the charged unit 40 is charged with electricity. The power supply unit 47 supplies electricity to the charged belt 42, so that the charged belt 42 is charged, e.g., with positive electric charges. When the charged belt 42 has been charged, electrostatic induction attracts and moves the phosphor particles f toward the charged belt 42, that is, toward surfaces of the phosphor layers F. In other words, the positive electric charges of the charged belt 42 and negative electric charges of the phosphors f attract each other.

Further, when the charged belt 42 is rotated by the driving motor 41 simultaneously while being charged to generate attraction between the charged belt 42 and the phosphors f, the phosphors f also move following the lead of the charged belt 42.

Therefore, while the slurry S flows downward along the inclined display panel 12 by gravity and capillary action, the phosphors f are carried by the slurry S while being floated adjacent to the surfaces of the phosphor layers F by the charged belt 42.

While the phosphor layers F are formed between the barrier ribs 12*b* in the way as described above, the thickness sensor 54 detects the thickness of the phosphor layers F and the location at which the phosphor layers F are formed (to which the slurry S has flowed). The detected location and thickness of the phosphor layers F are inputted to the information processing unit 56, and the information processing unit 56 compares the received data with values stored in advance and provides a control signal to the spray control unit 26.

Specifically, the information processing unit 56 obtains error values by comparing the detected location and thickness of each phosphor layer F with the preset values, generates correction values on the basis of the error values, and transmits the correction values to the spray control unit 26. Then, the spray control unit 26 operates the spray driving assembly 22 according to the received correction values, so as to adjust spray pressure and spray speed of the slurry S by the nozzle assembly 30 or 30'.

Meanwhile, when the slurry S has reached the last space between the barrier ribs 12*b*, that is, the slurry S has filled in all spaces between the barrier ribs 12*b*, the nozzle assembly 30 or 30' is stopped to prevent any more supply and flow of the slurry S. Then, the inclined base plate 10 is moved to be horizontally located. Then, the charged unit 40 is also moved to be horizontally located, parallel with the display panel 12.

Then, the phosphor layers F are dried. While the phosphor layers F are dried, the charged unit 40 is maintained in the charged state, in order to prevent the phosphor particles f from settling down in the phosphor layers F. However, it is not necessary to rotate the charged belt 42 during the drying of the films. Through the above process, the phosphor layers F are dried in the state in which the phosphor particles f are floated adjacent to the surfaces of the phosphor layers F. As a result, the phosphor particles f are located adjacent to the surfaces of the phosphor layers F in a manufactured display panel, thereby improving a light-emitting efficiency of the display panel.

Hereinafter, the operation of the charge unit 140 will be described with reference to FIG. 5.

When the slurry S flows through the spaces between the barrier ribs 12*b*, the charged unit substrates 141 are sequentially charged, so as to enable the phosphors f to easily and smoothly flow along with the slurry S.

For the sequential charge of the electrodes, electrodes of Nos. 1, 4, 7, and 10 are first charged by applying voltage to them, and the other electrodes are kept uncharged. Next, electrodes of Nos. 2, 5, 8, and 11 are charged by applying voltage to them, and the other electrodes are kept uncharged. Thereafter, electrodes of Nos. 3, 6, 9, and 12 are charged by applying voltage to them, and the other electrodes are kept uncharged. The sequential charge of the electrodes 142 in the way described above can have the same effect as that by rotation of the charged belt 42.

When the application of the slurry S has been completed, the base plate 10 is horizontally placed, so as to stop the slurry S from flowing on the display panel 12. The charged unit 140 is also horizontally placed while being kept apart from the surface of the display panel 12 on the base plate 10 by a uniform gap. Then, voltage is applied to all of the electrodes 142, so that all of the electrodes 142 are simultaneously charged. Then, the charges of the electrodes 142 have an effect on all the phosphor particles f of the phosphor layers of the display panel 12, so that the phosphor particles f will be located adjacent to the surfaces of the phosphor layers F.

According to the present invention as described above, not only does slurrys flow along a slantingly placed display panel, but also electrostatic force facilitates movement of phosphors f carried by the slurry S. Therefore, a process of forming phosphor layers F can be carried out more rapidly, and the phosphor particles f can be more uniformly distributed.

Further, while the phosphor layers F are dried, the phosphor particles f are located adjacent to the surfaces of the phosphor layers F by the electrostatic force. Therefore, the manufactured display panel has an improved light-emitting efficiency.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An apparatus for forming phosphor layers on a display panel, the apparatus comprising:

a base plate on which a display panel is placed, the display panel having a panel plate and barrier ribs formed on the panel plate;

a spray unit including a nozzle assembly for spraying a slurry containing phosphors into spaces between the barrier ribs of the display panel; and a charged unit for exerting electrostatic force on the phosphors contained in the slurry sprayed in the spaces between the barrier ribs, wherein said charged unit includes:

a driving motor; and a charged belt driven by said driving motor.

2. The apparatus according to claim 1, wherein at least a surface of said charged belt is made from a dielectric material.

3. The apparatus according to claim 2, further comprising:

a power supply unit for supplying electricity to said dielectric material of said charged belt so that said charged belt is selectively charged with electric charges.

4. The apparatus according to claim 3, wherein said charged unit is apart from a surface of the display panel by a predetermined gap and can be adjusted to be inclined at various angles.

5. The apparatus according to claim 1, wherein said charged unit includes:

a charged unit substrate having an area opposed to the base plate;

a plurality of electrodes arranged on a surface of said charged unit substrate; and a power supply unit for supplying electricity to said plurality of electrodes, wherein said charged unit substrate is separated from a surface of the display panel.

6. The apparatus according to claim 5, wherein said plurality of electrodes are arranged with a regular interval on said surface of said charged unit substrate.

7. The apparatus according to claim 5, wherein said power supply unit selectively supplies electricity to said plurality of electrodes to cause said phosphors to flow in the spaces between the barrier ribs.

8. The apparatus according to claim 5, wherein said charged unit substrate is spaced from the surface of the display panel by a predetermined gap and can be adjusted to be inclined at various angles.

9. The apparatus according to claim 1, wherein the base plate is inclined at an angle when the nozzle assembly sprays the slurry into in the spaces between the barrier ribs.

10. The apparatus according to claim 9, wherein the angle is adjustable to influence a flow rate of the slurry in the spaces between the barrier ribs.

11. The apparatus according to claim 1, wherein the base plate is inclined at a predetermined angle when the slurry is supplied to the spaces between the barrier ribs and is horizontally placed when the slurry is dried to form the phosphor layers.

12. The apparatus according to claim 1, wherein the nozzle assembly has at least one nozzle entrance port, a plurality of nozzle exit ports, and a plurality of fluid channels for interconnecting the at least one nozzle entrance port and the plurality of nozzle exit ports, the fluid channels including channels of different degrees, which are connected in such a manner that each channel is divided into at least two channels of a higher or next degree.

13. The apparatus according to claim 12, wherein the plurality of fluid channels have a curvilinear shape.

14. The apparatus according to claim 12, wherein the plurality of fluid channels have a semicircular or arcuate shape.

15. The apparatus according to claim 12, wherein the plurality of nozzle exit ports are spaced from each other to correspond to the spaces between the barrier ribs.

16. The apparatus according to claim 12, wherein said each channel has a sectional area which is at least twice as large as a sectional area of each of the at least two channels of the higher degree.

17. The apparatus according to claim 1, wherein said spray unit includes three nozzle assemblies for spraying slurries containing red, green and blue phosphors, respectively.

18. The apparatus according to claim 1, further comprising:

a supply tank for storing the slurry containing phosphors, wherein said spray unit further includes:

a spray driving assembly movably disposed in said supply tank so as to enable the slurry contained in said supply tank to be transferred to said nozzle assembly; and a spray control unit for controlling operation of said spray driving assembly so as to control a speed and pressure at which the slurry is sprayed out of said nozzle assembly.

19. The apparatus according to claim 1, further comprising:

a monitoring section for providing information to be used in controlling spray of the slurry onto the display panel, wherein said monitoring section includes:

an image acquisition unit for detecting flow of the slurry on the display panel; and a thickness sensor for detecting a thickness of the slurry applied on the display panel.

20. The apparatus according to claim 19, wherein said monitoring section further includes an information processing unit, which:

obtains error values by comparing a location and a thickness of the phosphor layers detected by said image acquisition unit and said thickness sensor with preset values;

generates correction values based on the error values; and transmits the correction values to said spray control unit.

* * * * *